US006414702B1

(12) United States Patent
Kubelik

(10) Patent No.: US 6,414,702 B1
(45) Date of Patent: Jul. 2, 2002

(54) PRINTHEAD WITH PLASMA SUPPRESSING ELECTRODES

(75) Inventor: Igor Kubelik, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/895,565

(22) Filed: Jun. 29, 2001

(51) Int. Cl.[7] ..... B41J 2/415
(52) U.S. Cl. ..... 347/127; 315/111.81; 361/229
(58) Field of Search ..... 347/123, 127, 347/128; 361/229; 250/426; 315/111.81; 29/890.1

(56) References Cited

U.S. PATENT DOCUMENTS 4,155,093 A 5/1979 Fotland et al. ..... 346/159
4,160,257 A 7/1979 Carrish ..... 346/159
4,745,421 A 5/1988 McCallum et al. ..... 346/159
5,742,468 A * 4/1998 Matsumoto et al. ..... 361/229

OTHER PUBLICATIONS

Philebrown, Peter "Electron Beam Imaging Enhancement through the application of Thin Film Technology", IS&T's 49$^{th}$ Annual Conference, Nov. 1997.

* cited by examiner

*Primary Examiner*—Joan Pendegrass
(74) *Attorney, Agent, or Firm*—Fay, Sharpe, Fagan, Minnich & McKee, LLP

(57) ABSTRACT

A printhead having a plasma suppressing electrode configuration is disclosed. The printhead includes a first electrode layer. There is also a second electrode layer, electrically insulated from the first electrode layer by a dielectric material. In addition, there is a plurality of plasma suppressing electrodes arranged within the dielectric material to hinder plasma generation at predetermined locations.

19 Claims, 7 Drawing Sheets

PRINTHEAD WITH PLASMA SUPPRESSING ELECTRODES

FIELD OF THE INVENTION

The invention relates to a printhead suitable for use with image forming systems, and more particularly relates to the utilization of one or more electrodes for blocking electric field transmission to prevent plasma generation in predetermined locations within the printhead.

BACKGROUND OF THE INVENTION

Current image forming systems utilize different printhead technologies to form desired printed images. Some of the printhead technologies include a process of charging a surface of an image-receiving member, such as a dielectric drum, with a latent charge image. The term image-receiving member includes any suitable structure supporting the latent image of charge, and can include a dielectric or photoconductive drum, a flat or curved dielectric surface, or a flexible dielectric belt, which moves along a predetermined path. The image-receiving member can also comprise a liquid crystal, phosphor screen, or similar display panel in which the latent charge image converts into a visible image. The image receiving member typically includes on an exterior surface a material such as a dielectric or photoconductor that lends itself to receiving the latent charge image. A number of organic and inorganic materials are suitable for the dielectric layer of the image receiving member. The suitable materials include glass enamel, anodized and flame or plasma sprayed high-density aluminum oxide, and plastic, including polyamides, nylons, and other tough thermoplastic or thermoset resins, among other materials.

The image receiving member moves past an image forming device, such as a printhead, which produces streams of accelerated electrons as primary charge carriers. The electrons reach the drum, landing in the form of a latent charge image. The latent charge image then receives a developer material, to develop the image, and the image is then transferred and fused to a medium, such as a sheet of paper, to form a printed document.

The printhead most often includes layers having a multi-electrode structures that define an array of charge generation sites. Each of the charge generation sites, when the electrodes are actuated, generates and directs toward the drum a stream of charge carriers, e.g., electrons, to form a pointwise accumulation of charge on the drum that constitutes the latent image. A representative printhead generally includes a first collection of drive electrodes, e.g., RF-line electrodes, oriented in a first direction across the direction of printing. A second collection of control electrodes, e.g., finger electrodes, oriented transversely to the drive electrodes, forms spatially separated cross points with the first collection of drive electrodes. In the cross points, electrodes form charge generating sites at which charges originate. A dielectric layer couples to, and physically and electrically separates and insulates, the RF-line electrodes from the finger electrodes.

The printhead can also include a second dielectric or insulating layer and a third electrode structure, often identified as a screen electrode. The second dielectric/insulating layer couples to the finger electrodes and the screen electrodes. The screen electrode, usually in the form of a conductive sheet, has a plurality of apertures aligned with the charge generation sites to allow the stream of charge carriers to pass through. The polarity of the charge carriers passing through the apertures depends on the voltage difference applied to the finger and screen electrodes. The polarity of the charged particles accumulated on the drum to create latent images is determined by the voltage difference between the screen electrode and the drum surface. The charged particles of appropriate polarity are inhibited from passing through the aperture, depending upon the sign of their charge, so that the printhead emits either positive or negative charge carriers, depending on its electrode operating potentials.

In some instances, it is desirable to prevent the creation of plasma, and thus, the generation of charged particles in certain places that have not been properly sealed due to structural or systematic constraints. Typically, places where undesired plasma can eventually arise are the gaps between the finger electrodes in the cross points with the RF-line electrodes. Such places are usually sealed by a dielectric that is simultaneously used as a spacer layer between the screen and the finger electrodes. In printheads suitable for high resolution print, and especially for printheads with a low number of RF-electrodes, sealing of the gaps between the finger electrodes by the dielectric spacer layer can be difficult. In addition, in such printheads with a high density of finger electrodes, the dielectric spacer interacts with the plasma resulting from the charge generation sites. In the typical case of spacers made of an organic material, the interaction with plasma results in degradation of the charge generation capability, and therefore in degradation of the print quality and in shortening of the printhead life.

SUMMARY OF THE INVENTION

There exists in the art a need for a printhead that does not require the use of dielectric layers to suppress the plasma formation in predetermined locations along the finger electrodes. The present invention is directed toward such a solution.

A printhead, in accordance with one example embodiment of the present invention, has at least a first electrode layer (e.g., RF-line electrodes) and at least a second electrode layer (e.g., finger electrodes). Electrodes of both layers are electrically insulated with respect to each other by a dielectric material. There is, in addition, a plurality of plasma suppressing electrodes arranged within the dielectric material to hinder plasma generation at predetermined locations.

The present invention further provides for a printhead having a first electrode layer and a second electrode layer that are electrically insulated from each other by a dielectric material and a plurality of plasma suppressing electrodes disposed exterior to one of the electrode layers. An additional dielectric segment is located between the electrode layer and the plasma suppressing electrodes.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

The present invention generally relates to a printhead within an image forming system. A characteristic of the printhead is that there exists at least one plasma suppressing electrode. The general structure of the printhead includes at least two electrode layers electrically insulated from one another by a dielectric structure or material. The plasma suppressing electrode, or electrodes, are then placed in predetermined locations to suppress the local electric field, and therefore eliminate plasma generation in such locations. The plasma suppressing electrodes eliminate the need for the use of additional dielectric layers to seal the areas with undesirably high electric fields to accomplish a similar end result of plasma suppression. Such dielectric layers used in the known structures are typically organic. The interaction of the organic dielectric layers with plasma reduces the printhead life.

FIGS. 1 through 7 illustrate an example embodiment of a printhead according to the teachings of present invention. Although the present invention will be described with reference to the example embodiments illustrated in the figures, it should be understood that the present invention can be embodied in many alternative forms. Any suitable size, shape, or type of elements or materials can also be utilized.

The image forming system illustrated, for example, is shown solely for the purpose of providing a general structure into which the present invention can fit. One skilled in the art will understand that other image forming systems or charge transfer apparati can be utilized in combination with different embodiments of the present invention, without departing from the spirit and scope of the present invention. Image forming systems in fact include a collection of the known technologies adapted to capture and/or store image data associated with a particular object, such as a document, and reproduce, form, or produce an image.

Figure 1:
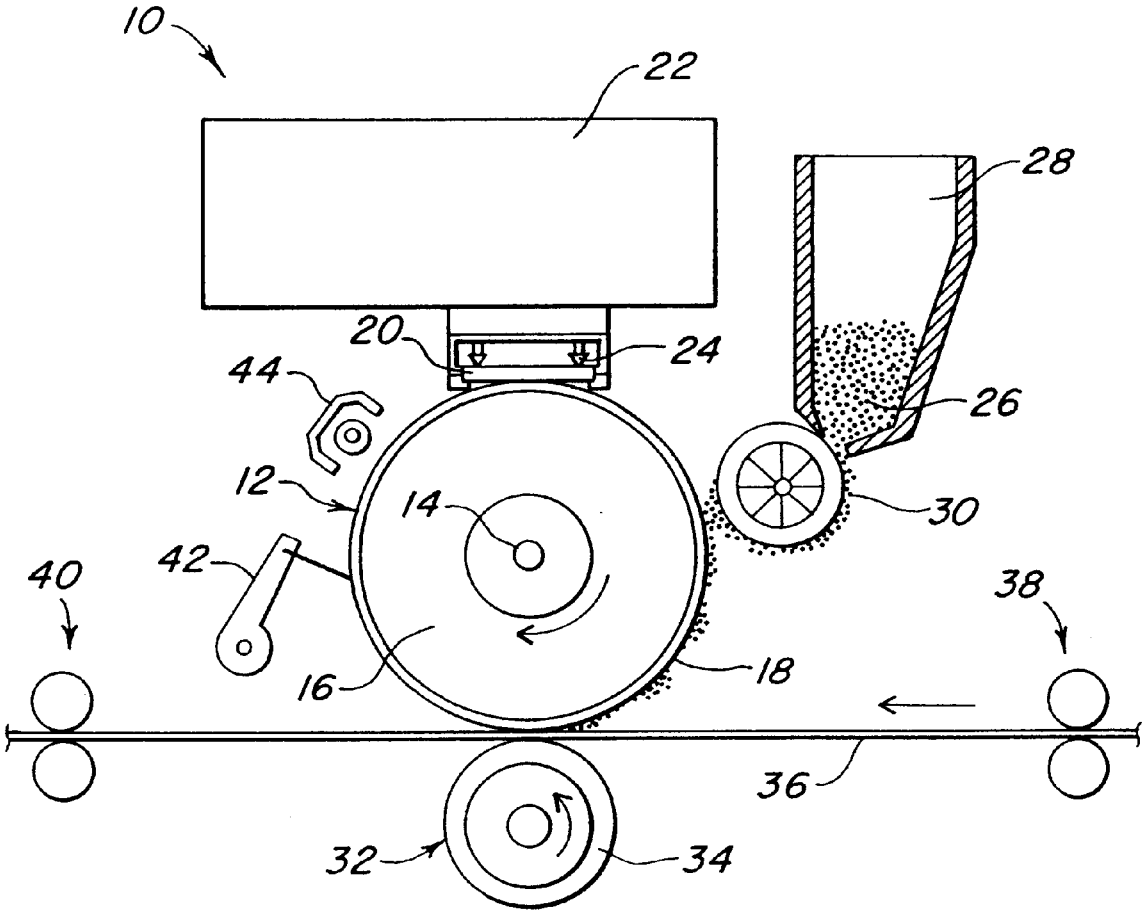
FIG. 1 is a diagrammatic illustration of an image forming system suitable for use with the printhead of the present invention.

FIG. 1 illustrates one such image forming system 10 known as Electron Beam Imaging (EBE). An image receiving member, such as a drum 12, rotates about an axis 14 in the image forming system 10. The drum 12 incorporates an electrically conductive core 16 coated with a dielectric layer 18. A belt, in an alternative structure not shown, supports the dielectric layer and circulates around several wheel mechanisms.

The dielectric layer 18 receives a charged image from a printhead 20. Electrical connectors 24 connect a controller 22, which drives the printhead 20 as desired. As the drum 12 rotates in the direction of the arrow shown at axis 14, charge from the proper charge generating sites inside the printhead 20 is accelerated toward the drum dielectric surface 18 to create a latent image. A toner hopper 28 feeds toner particles 26 through a feeder 30 to bring the particles 26 into contact with the drum dielectric layer 18 surface. The toner particles 26 electrostatically adhere to the charged areas on the dielectric layer 18, developing the charged image into a toner image. The rotating drum 12 then carries the toner image towards a nip formed with a pressure roller 32. The pressure roller 32 has an outer layer 34 positioned in the path of a receptor, such as a paper sheet 36. The paper sheet 36 enters between a pair of feed rollers 38. The pressure in the nip is sufficient to cause the toner particles 26 to transfer and permanently affix to the paper sheet 36. The paper sheet 36 continues through and exits between a pair of output rollers 40. After passing through the nip between the drum 12 and the pressure roller 32, a scraper blade assembly 42 removes any toner particles 26 that may remain on the dielectric layer 18. An eraser 44 positioned between the scrapper blade assembly 42 and the printhead 20 removes any residual charge remaining on the dielectric layer 18 surface. The process then repeats for the next image.

A conventional printhead configuration utilized in EBE image forming systems can be described as follows. The printhead includes at least a first electrode layer having a plurality of driving electrodes, called RF-electrodes, sealed and electrically isolated by the dielectric layer or structure. On an opposite side, the dielectric layer further couples to a second electrode layer. The second electrode layer also comprises a plurality of electrodes, called finger electrodes, which cross the plurality of RF-line electrodes to create a matrix of plasma generating sites from which the charge is extracted. Often, the printhead is completed with a third electrode layer, known as the screen electrode, which is spaced and isolated from the finger electrodes by a second dielectric layer. The screen electrode is provided with openings that are in register with the plasma generating loci.

Figure 2:
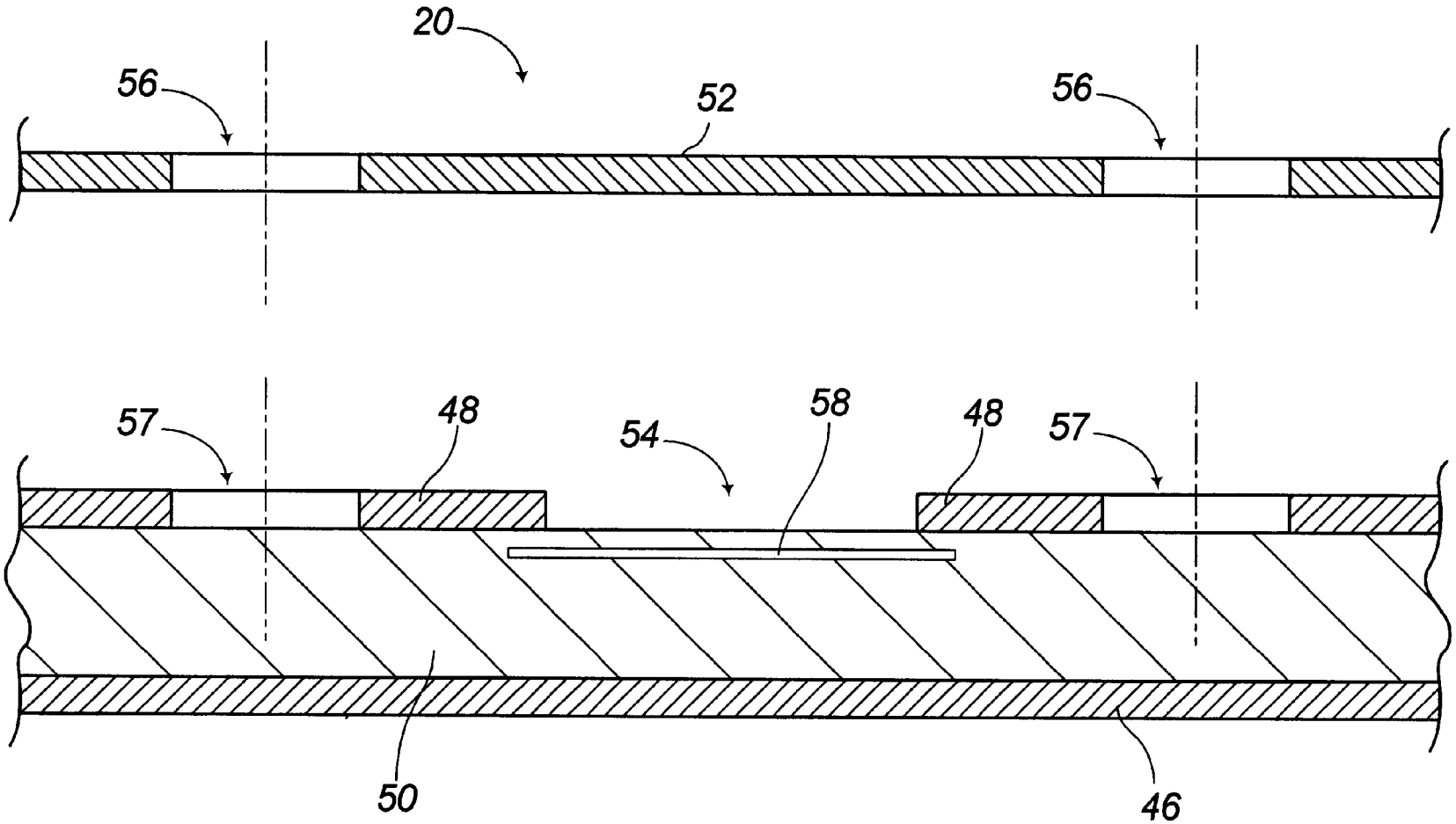
FIG. 2 is a diagrammatic cross-section of a portion of the printhead according to one aspect of the present invention.

FIG. 2 illustrates a schematic cross-section of a portion of the printhead 20 according to the teachings of the present invention. The printhead 20 illustrated in FIG. 2 includes the feature of a plasma suppressing electrode 58. The printhead 20 structure includes an RF-line electrode 46 that is sealed by a dielectric structure 50, which additionally bonds with finger electrode layer 48. The dielectric structure 50 in this instance is any combination of dielectric material forming a layer or layers of dielectric for insulating the electrode layers 46 and 48 from each other. The suppressing electrode 58, shown as an insert in the dielectric structure 50, is an electrically conductive layer capacitively or resistively coupled, in general, with the finger electrodes 48.

A screen electrode 52 mounts distal from the finger electrode layer 48. The finger electrode layer 48 has a plurality of individual electrodes separated by the finger gaps 54. The finger electrodes are provided with holes 57 forming charge generation sites that are substantially in alignment with screen holes 56 in the screen electrode 52. This arrangement allows charge to be emitted from the finger holes 57, through the screen holes 56, and out of the printhead 20 toward an image receiving member.

Undesirable plasma formation in the finger gaps 54 is blocked by plasma suppressing electrodes 58 positioned in registration with each of the finger gaps 54. The plasma suppressing electrodes 58 that are buried within the dielectric structure 50, and are therefore electrically isolated from the finger electrodes 48, as well as the RF-line electrodes 46, have a potential close to the potentials of the finger electrodes 48. The chosen potential is preferably in a range between potentials corresponding to the finger electrode 48 "on" and "off" states. Biasing of the plasma suppressing electrodes 58 can be done by direct connection of the plasma suppressing electrode 58 with a power supply (not shown), or by capacitive coupling with the finger electrodes 48.

The arrangement of the plasma suppressing electrodes 58 practically eliminates the local electric fields in the particular finger gaps 54, and therefore substantially hinders plasma generation in these locations.

Figure 3:
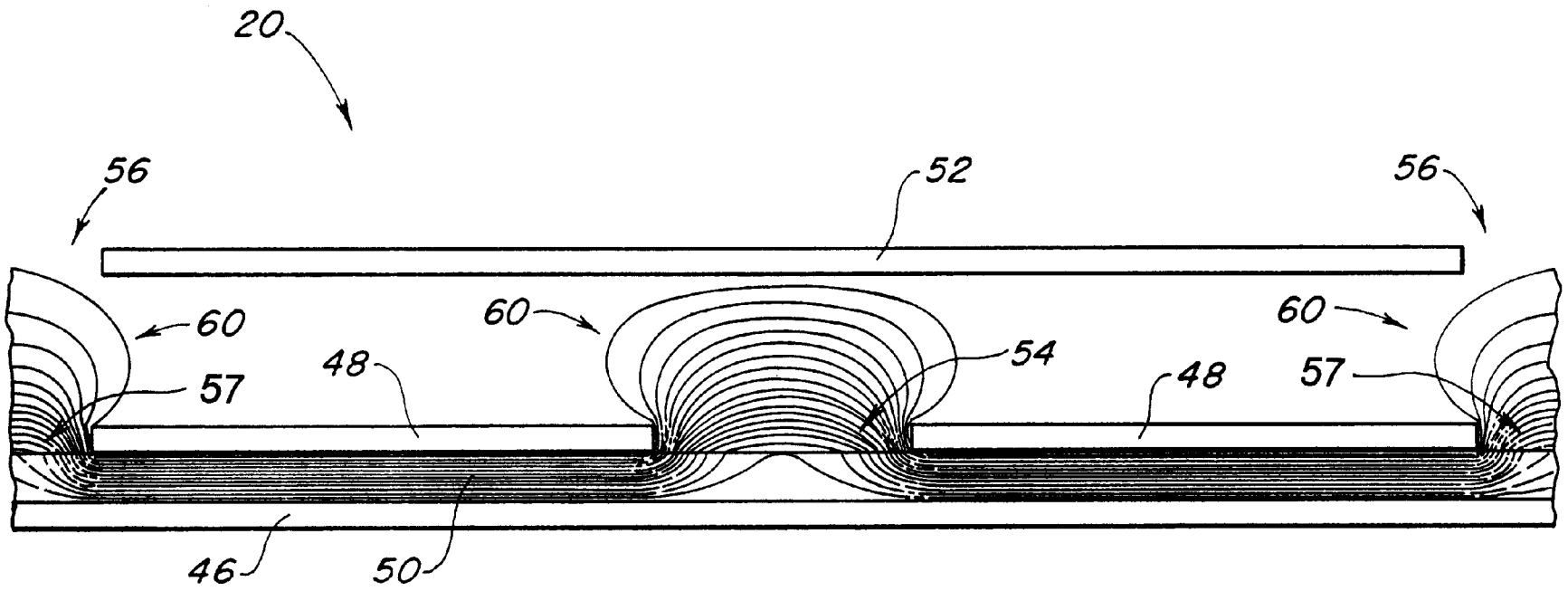
FIG. 3 is a diagrammatic illustration of an electric field within a printhead.

FIG. 3 shows a calculated electric field distribution in the cutaway portion of the printhead 20 when no plasma suppressing electrodes 58 are present. The RF-line electrodes 46 bond with the dielectric structure 50, which in turn bonds with the finger electrodes 48. The screen electrode 52 is distal from the finger electrode layer 48, held in place by spacers (not shown). A strong electric field 60 arises in all places above the RF-line electrodes 46 whenever continuity of the finger electrode layer 48 is interrupted. While such fields are vital in the finger holes 57 where they, by plasma, generate charged particles for printing, they are undesirable in all other places like gaps 54 between the finger electrodes 48. At the gap 54 locations the high electrical fields can cause direct discharge between the screen electrode 52 and finger electrodes 48, resulting in a full destruction of the printhead or the overall erosion of materials used in printhead construction. Therefore, it is generally desirable to suppress such electric fields 60 formed in the finger gaps 54 of the printhead 20 illustrated, while still allowing electric fields 60 in the finger hole 57 locations.

Figure 4:
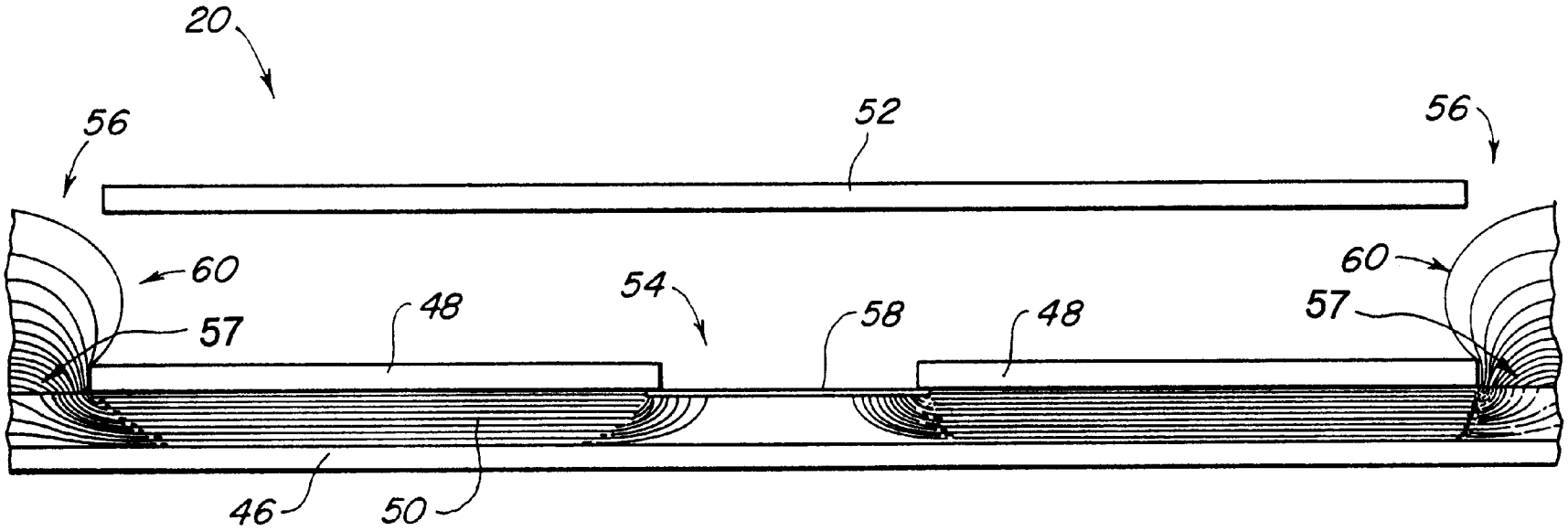
FIG. 4 is a diagrammatic illustration of an electric field within a printhead according to the teachings of the present invention.

FIG. 4 shows, in a partial cross-sectional view of the printhead 20, the electric field distribution in the printhead 20 wherein an electric field suppressing electrode 58 is installed. The presence of the suppressing electrodes 58 in the finger gaps 54 practically eliminates the local electric field above the dielectric structure 50, and therefore also eliminates the possibility of plasma formation without the need for an additional dielectric layer.

Figure 5:
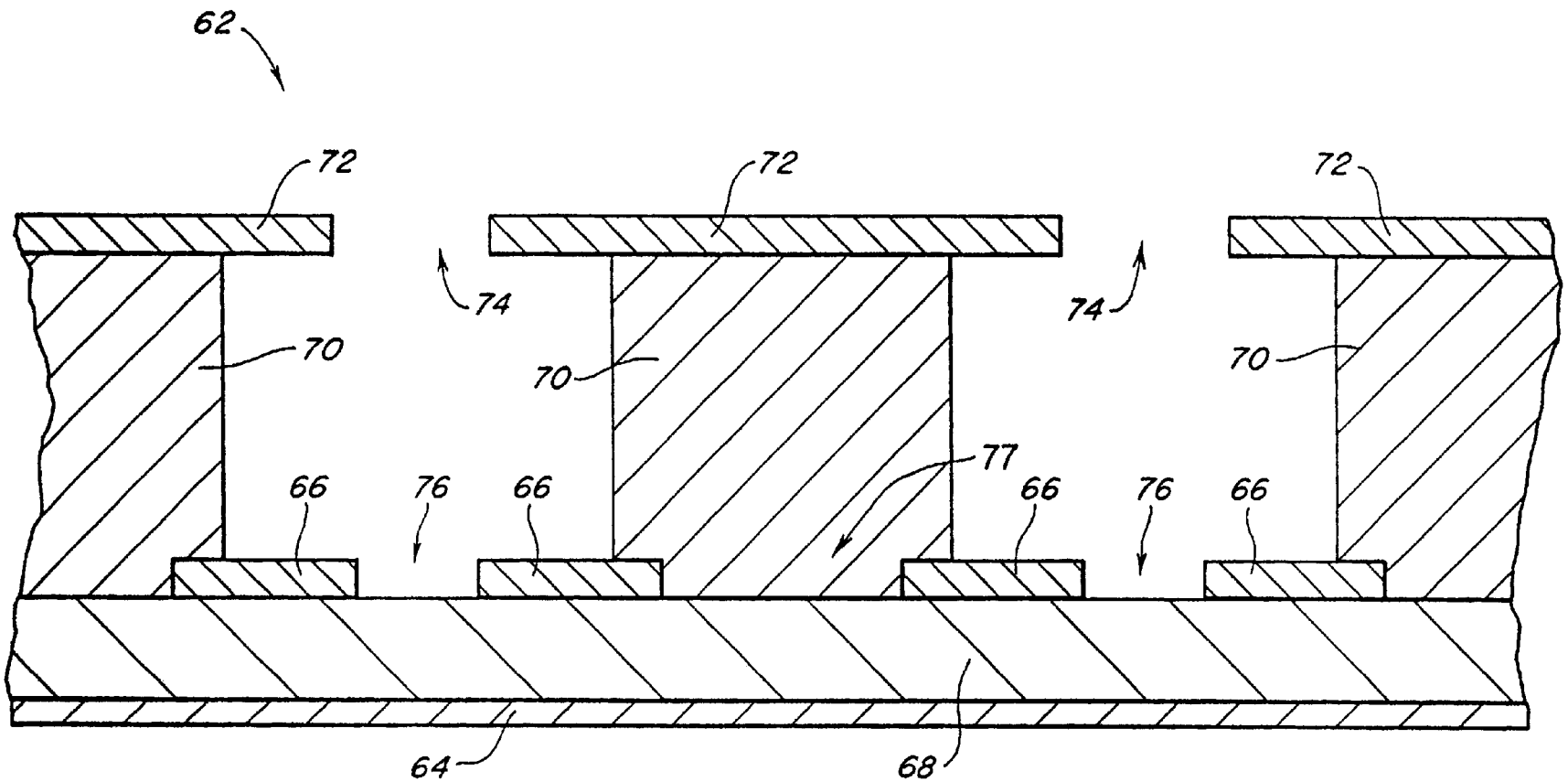
FIG. 5 (Prior Art)
FIG. 5 is a diagrammatic cross-section of a printhead having a dielectric spacer layer and a screen electrode.

FIG. 5 is a schematic cross-section view of a portion of a printhead 62 in a known configuration that does not include a plasma suppressing electrode. An RF-line electrode 64 bonds with a dielectric structure 68, which in turn bonds with finger electrode layer 66. Spacers 70 extend from both the dielectric structure 68 and the finger electrode layer 66 to support a screen electrode 72. Finger holes 76 are aligned with screen holes 74, while spacers 70 supporting screen electrodes 72 block finger gaps 77 between the finger electrodes 66. In such a structure, the spacers 70 are required to extend over entire finger gaps 77 to encompass and seal the finger electrodes 66 to prevent any electric field from generating plasma in that location.

Figure 6:
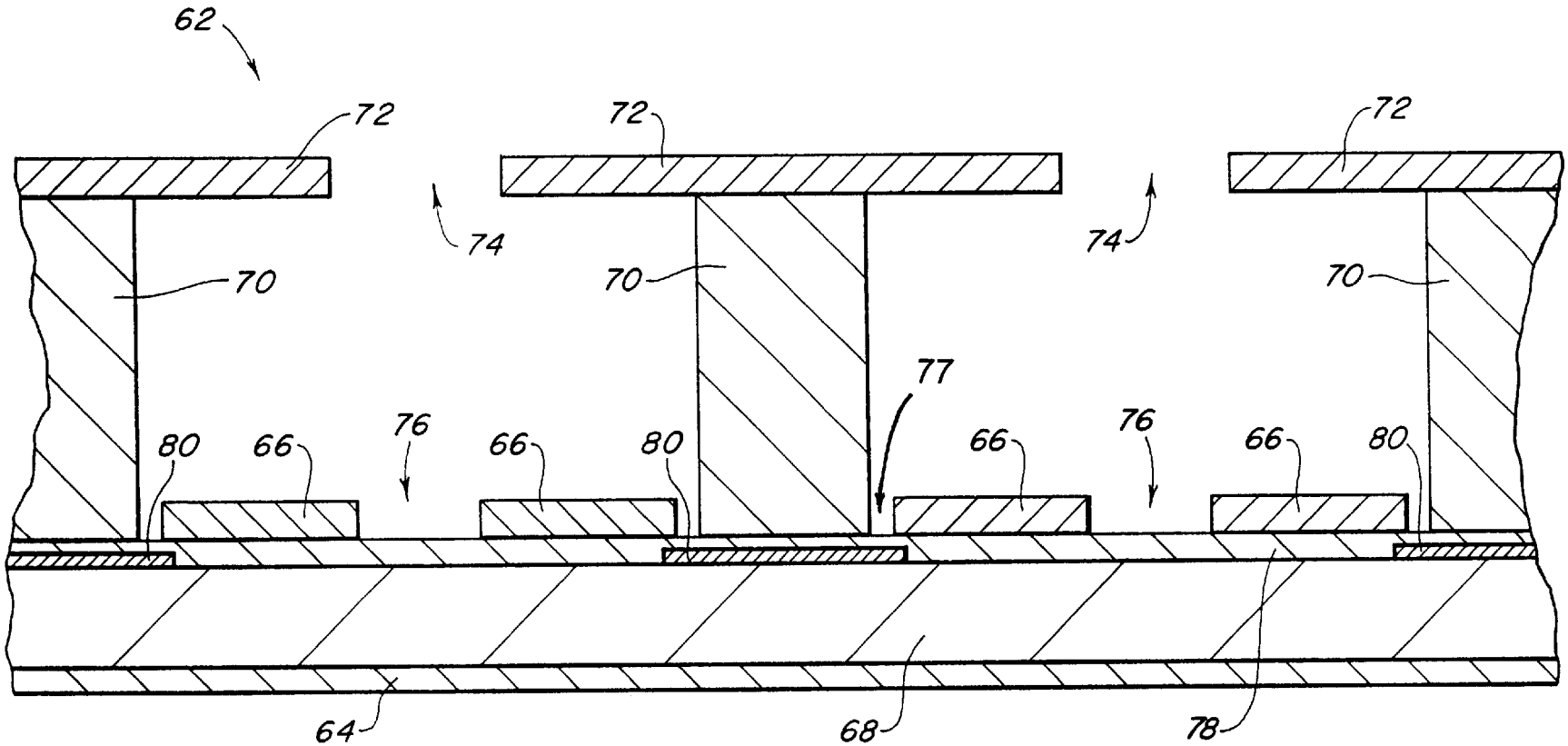
FIG. 6 is a diagrammatic cross-section of a printhead having a dielectric or conductive spacer layer and a screen electrode in accordance with the teachings of the present invention.

In FIG. 6, plasma suppressing electrodes 80 are included within the basic configuration of the printhead 62, according to the teachings of the present invention. In this construction, the dielectric structure is made of two portions 68 and 78. The first dielectric portion 68 bonds to the RF-line electrodes 64 on one side, while the opposite side supports the plasma suppressing electrodes 80. The plasma suppressing electrodes 80 are sealed and electrically isolated by the second dielectric portion 78, which in turn bonds to the finger electrodes 66. Finger holes 76 are aligned with screen holes 74, while the plasma suppressing electrodes 80 are in registration with finger gaps 77 between the finger electrodes 66. In such an arrangement, the printhead can be built with or without internal spacers 70 extending from the second part of the dielectric 78 to support the screen electrodes 72. These spacers can both be smaller in size and made of almost any material, such as organic as well as inorganic materials with electroconducting or isolating properties.

Figure 7:
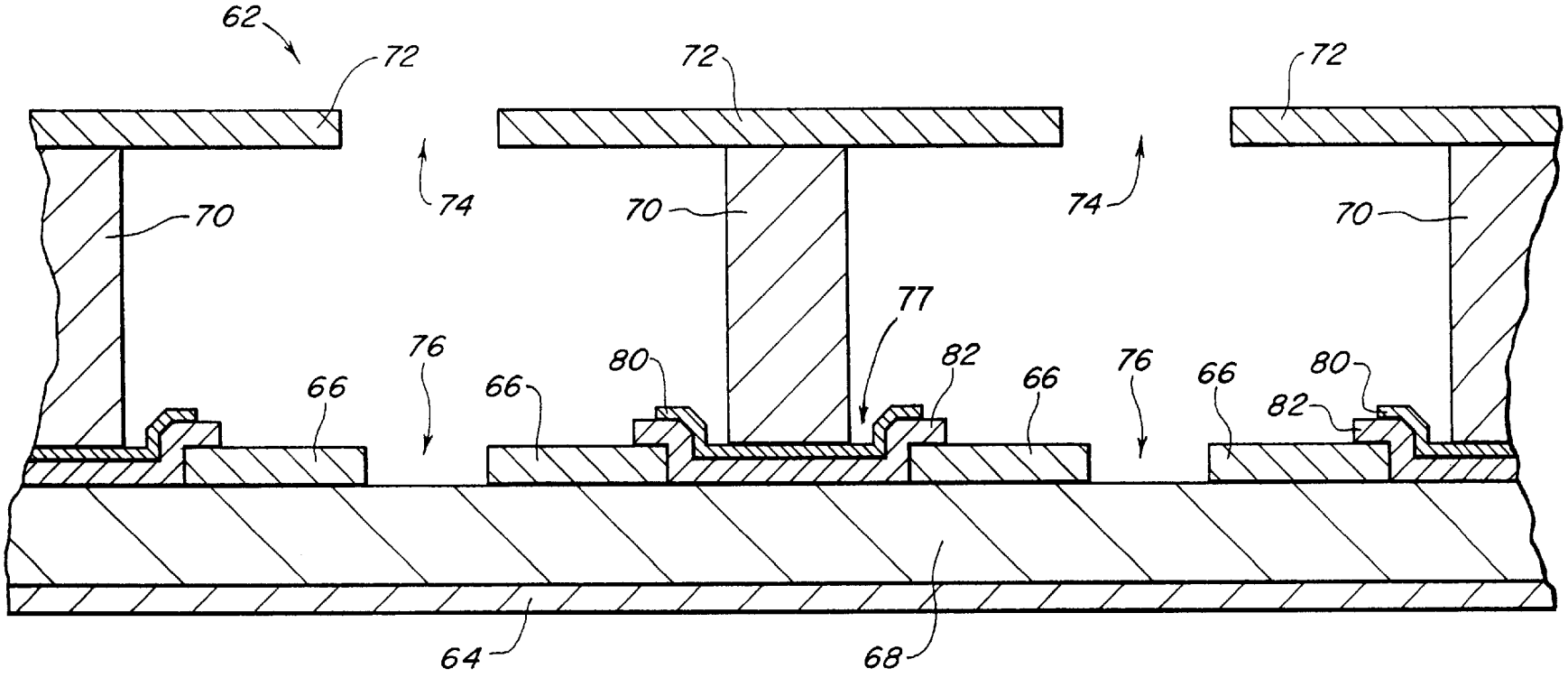
FIG. 7 is a diagrammatic cross-section of an alternate embodiment of the printhead according to the teachings of the present invention.

FIG. 7 illustrates an alternate embodiment of the printhead 62 according to the teachings of the present invention. This arrangement differs from that of FIG. 6 in that the second dielectric portion 82 seals a top portion and a side portion of individual finger electrodes 66 to block the finger gaps 77, rather than being placed beneath the finger electrode 66 layer. The plasma suppressing electrode 80 in such an instance is disposed over the second dielectric portion 82 and needs to be sufficiently small to be insulated from the individual finger electrodes 66. The spacer 70 then extends directly from the plasma suppressing electrode 80 to support the screen electrode 72.

The plasma suppressing electrodes can be made of a number of different electrode materials, such as any conducting (Au, Cu, Cr, Mo, and the like) or semiconducting (Si, Ge, C, and the like) materials.

There are many advantages associated with the use of the plasma suppressing electrodes as described herein. For example, using plasma suppressing electrodes as for elimination of the use of a plastic sealant from the close vicinity of the plasma generation sites. This results in a significant printhead life span increase. Further, this elimination of the requirement of a sealant enables the reduction of both the spacer and finger widths. This instead can result in an increased finger density. Higher finger density can enhance the printed dot density or allows for the reduction of the number of driving electrodes. These advantages help increase the print speed, enhance the gray level printing, and electronically compensate the charge output non-uniformity. One can fully remove the spacer in some instances, requiring support for the rigid screen to originate from outside of the finger active area, which further enhances the printhead life span and performance.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. In an image forming system, a printhead, comprising:

a first electrode layer;

a second electrode layer electrically insulated from said first electrode layer by a dielectric material;

one or more suppression electrodes coupled to said dielectric material for suppressing charge emissions at predetermined locations.

2. The printhead of claim 1, wherein said first electrode layer comprises an RF-line electrode layer.

3. The printhead of claim 2, wherein said second electrode layer comprises a finger electrode layer.

4. The printhead of claim 1, further comprising at least one screen electrode layer.

5. The printhead of claim 4, further comprising a spacer for separating said at least one screen electrode from said first and second electrode layers.

6. The printhead of claim 1, wherein said suppression electrodes are disposed within said dielectric material.

7. The printhead of claim 1, wherein said first electrode layer of said printhead is adapted to emit charge when actuated.

8. The printhead of claim 7, wherein said one or more suppression electrodes are arranged on a side of said dielectric material opposite said first electrode layer.

9. The printhead of claim 7, wherein the dielectric material comprises multiple layers to insulate each of said plurality of suppression electrodes from said first electrode layer.

10. A method of forming a printhead, comprising the steps of:

forming a first electrode layer;

depositing a dielectric material layer;

inserting one or more suppression electrodes coupled with said dielectric material layer;

depositing additional dielectric material over said one or more suppression electrodes; and forming a second electrode layer, electrically insulated from said first electrode layer and said one or more suppression electrodes by said dielectric material.

11. A printhead, comprising:

at least a first electrode layer having a first plurality of electrodes;

at least a second electrode layer having a second plurality of electrodes forming a plurality of charge generation sites at intersections with said first plurality of electrodes, said at least first electrode layer being electrically insulated from said second electrode layer by a dielectric material; and a plurality of suppression electrodes arranged within said printhead at predetermined locations to suppress plasma generation at predetermined charge generation sites.

12. The printhead of claim 11, wherein said at least first electrode layer comprises an RF-line electrode layer.

13. The printhead of claim 12, wherein said at least second electrode layer comprises a finger electrode layer.

14. The printhead of claim 11, further comprising at least one screen electrode layer.

15. The printhead of claim 14, wherein said at least one screen electrode is separated from said at least first and at least second layers of electrodes by at least one spacer.

16. The printhead of claim 11, wherein said plurality of plasma suppressing electrodes are arranged within said dielectric material.

17. The printhead of claim 11, wherein charge emission occurs from said second electrode layer side of said printhead.

18. The printhead of claim 17, wherein said plurality of plasma suppressing electrodes are arranged on an opposite side of said second electrode layer from said dielectric material.

19. The printhead of claim 18, wherein an additional dielectric segment electrically insulates each of said plurality of plasma suppressing electrodes from said second electrode layer.

* * * * *